US006155423A

United States Patent [19]

Katzner et al.

[11] Patent Number: 6,155,423

[45] **Date of Patent: *Dec. 5, 2000**

[54] BLISTER PACKAGE AND PACKAGED TABLET

[75] Inventors: Leo D. Katzner, Shakopee, Minn.; Brian Jones, Irvine, Calif.; Jack Khattar; John Kosewick, both of Eden Prairie, Minn.

[73] Assignee: Cima Labs Inc., Eden Prairie, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/053,298

[22] Filed: Apr. 1, 1998

Related U.S. Application Data

[60] Provisional application No. 60/042,566, Apr. 1, 1997.

[51] Int. Cl.[7] ..... B65D 83/04

[52] U.S. Cl. ..... 206/531; 206/534; 206/539; 206/469

[58] Field of Search ..... 206/532, 534, 206/534.1, 539, 469, 471

[56] References Cited

U.S. PATENT DOCUMENTS

| | | | |
|---|---|---|---|
| D. 370,625 | 6/1996 | Kelsey et al. . | |
| 2,012,405 | 8/1935 | Salfisberg . | |
| 3,311,229 | 3/1967 | Troll et al. . | |
| 3,503,493 | 3/1970 | Nagy . | |
| 3,630,346 | 12/1971 | Burnside | 206/539 |
| 3,872,970 | 3/1975 | Edison . | |
| 3,924,746 | 12/1975 | Haines . | |
| 3,941,248 | 3/1976 | Moser et al. . | |
| 3,948,394 | 4/1976 | Hellstrom . | |
| 4,011,949 | 3/1977 | Braber et al. . | |
| 4,158,411 | 6/1979 | Hall et al. . | |
| 4,231,477 | 11/1980 | DeFelice . | |
| 4,234,084 | 11/1980 | Hutten | 206/306 |
| 4,243,144 | 1/1981 | Margulies . | |
| 4,280,621 | 7/1981 | Tonrey | 206/534 |
| 4,391,368 | 7/1983 | Washington, Jr. . | |
| 4,398,634 | 8/1983 | McClosky . | |
| 4,537,312 | 8/1985 | Intini . | |
| 4,753,352 | 6/1988 | Dauphin et al. | 206/538 |
| 5,033,616 | 7/1991 | Wyser . | |
| 5,046,618 | 9/1991 | Wood . | |
| 5,172,812 | 12/1992 | Wharton et al. . | |
| 5,339,960 | 8/1994 | Price | 206/531 |
| 5,560,490 | 10/1996 | Chawla | 206/539 |
| 5,775,505 | 7/1998 | Vasquez et al. | 206/538 |
| 5,791,478 | 8/1998 | Kalvelage et al. | 206/531 |

FOREIGN PATENT DOCUMENTS 28 34 848 A1 2/1980 Germany .

OTHER PUBLICATIONS

Declaration of Jack Khattar and attachments.

*Primary Examiner*—Paul T. Sewell
*Assistant Examiner*—Nhan T. Lam
*Attorney, Agent, or Firm*—Lerner, David, Littenberg, Krumholz & Mentlik, LLP

[57] ABSTRACT

The invention is a blister package for containing frangible dosage forms while protecting the dosage forms from damage during transport and opening of the package.

A blister sheet defines one or more recesses in which frangible dosage forms are disposed and a peelable sheet of lidding material overlies the recesses to cover the dosage forms therein. The dosage forms engage each recess to prevent shifting of the dosage form during transport. Indicia on the blister package directs the user with regard to the procedure for opening the package without damaging the dosage forms. Unsealed areas in the package, which provide a portion of lidding material which the user can grab to peel open the package, are provided with dimples which hide the grabable portion of lidding material from children.

8 Claims, 2 Drawing Sheets

BLISTER PACKAGE AND PACKAGED TABLET

CROSS REFERENCE TO RELATED APPLICATIONS

This application claims benefit of U.S. Provisional Application Ser. No. 60/042,566 filed Apr. 1, 1997, the disclosure of which is incorporated by reference herein.

FIELD OF THE INVENTION

The present invention relates to packages for frangible pharmaceutical dosage forms and the packaged frangible pharmaceutical forms.

BACKGROUND OF THE INVENTION

The present invention is particularly useful in packaging frangible dosage forms which are easily damaged during transport of the package and easily damaged by the user upon opening. The disclosures of commonly assigned U.S. Pat. Nos. 5,178,878 and 5,223,264, which are hereby incorporated by reference herein, describe one form of relatively soft tablets which are susceptible to damage. These tablets include, in addition to the active ingredients, an effervescent composition so that when the tablet is orally administered to a patient, it disintegrates. These tablets are very soft with a hardness typically below about 20 Newtons and in some cases below 10 Newtons.

Pharmaceutical dosage forms, such as pills, capsules, tablets and the like, may be packaged in blister packages, which are comprised of multi-layered sheets of material having pockets for containing the dosage forms. Conventional blister packages include packages having a foil layer through which a user of the package must push the tablet, breaking the foil. Hall et al., U.S. Pat. No. 4,158,411, discusses such a blister package. Blisters having open tops for containing pharmaceutical tablets are formed in a flexible sheet of plastic material. A paperboard layer having disc-shaped punch-outs covers the open tops of the blisters overlying each dosage form. A foil layer covers the paperboard layer, holding the punch-outs in place. To open the package, the user must collapse the blister and push the tablet through the foil, also removing the punch-outs. This push-through package would damage soft tablets and other frangible dosage forms when the user pushes the package to collapse the blister. In addition, the tablet or other dosage form is free to shift within the blister, presenting the opportunity for the dosage form to become damaged upon transport.

Another type of blister package provides perforations between separable blister units so that the user can separate an individual dosage from the package prior to opening. U.S. Pat. No. 4,398,634 to McClosky, illustrates a blister package of this type. The blister portions are defined by tear-resistant, substantially planar plastic sheets sealed to one another in seal zones. The seal zones are located around the periphery of each blister unit, forming pockets of unsealed areas which define the blisters, centrally located in the blister unit. Weakened areas in the seal zones allow the user to separate the blisters into individual units by tearing a unit away from the package. Upon separation of the unit, the user tears through the plastic layers, through the blister, to gain access to the dosage form. A slit in the corner of the unit is provided for easy tearing. During separation of a unit from the package, the plastic tends to tear through the remaining blisters in the package, destroying the package. Each weakened area meets at a central uncut area provided to reduce tearing through the remaining blisters in the package. Because the user is required to tear through a blister to gain access to the dosage form, frangible tablets in a package of this type would be destroyed by the user upon opening the package.

Another type of blister package includes individual units which, upon separation, reveal a tab for opening the blister. U.S. Pat. No. 5,046,618 to Wood discloses this type of blister package. The blister package is formed from a sheet of material having blisters formed therein and a substantially planar lidding sheet. This blister package has two rows of blisters, each blister unit separated from an adjacent unit by perforations. The rows are separated by tear strips with perforations between the tear strips and the blister units. To open the package, a user separates an individual unit from the package with a tear strip still attached to the unit. This tear strip must be removed to access the tab, which comprises an unsealed area on the corner of the blister unit. After the tear strip is removed, the user grabs the corner of the lidding sheet and peels the sheet back to reveal the dosage form. It is not disclosed that the package protects frangible dosage forms from becoming damaged.

Indicia provided on blister packages could be directed to guiding the user in opening the package so as to avoid damage to the dosage form. U.S. Pat. No. 3,503,493 to Nagy discloses indicia visible from the top side of the blister package, the side opposite the side having blisters, indicating the type of pharmaceutical contained in the package. U.S. Pat. No. 4,158,411 to Hall et al. discusses indicia for guiding the user regarding a schedule for consuming the pharmaceutical contained in the package. The indicia are reference numerals corresponding to each dosage, indicating to the user when a dose must be taken. The indicia discussed in U.S. Pat. No. 5,511,665 relates to the opening of the package but is provided as a diversion, to direct children to disarm the package so that it cannot be easily torn open.

Thus, despite the substantial time and effort expended to solve the problems associated with packages for dosage forms, further improvement in such packages would be desirable.

SUMMARY OF THE INVENTION

The present invention improves upon packages for frangible dosage forms.

A packaged dosage form in accordance with one aspect of the present invention comprises a blister package formed by a blister sheet defining one or more recesses in which frangible dosage forms are disposed and a sheet of lidding material overlying the recesses to cover the dosage forms therein. Each recess has an open top, a closed bottom remote from the top, and walls extending between the open top and the bottom. The frangible dosage form disposed in each recess engages the walls of each recess so that the walls hold the dosage form away from the bottom of the recess and adjacent the lidding material. This aspect protects the dosage form from damage by preventing shifting of the dosage form during transport. An empty space between each dosage form and the bottom of the recess in which the dosage form is disposed cushions the dosage form from impact when the package is dropped. The sheet of lidding material is peelably attached to the blister sheet so that a user of the package may peel back the lidding material to gain access to the dosage form.

The blister sheet of the packaged dosage form may define a flange surrounding the open top of each recess and a generally planar top surface facing in an upward direction. Where a flange is provided, the lidding material sheet is peelably attached to the flange of the blister sheet so that the lidding material sheet overlies the dosage forms in each recess.

The packaged dosage form may be comprised of a blister sheet having a plurality of recesses containing dosage forms arranged, for example, in rows and columns. In this example, each flange associated with each recess is substantially coplanar with and connected to adjacent flanges and the sheet of lidding material covers the plurality of flanges. Thus, the blister package includes a plurality of unit packages, each unit package incorporating one recess, a portion of the lidding sheet overlying that recess, and the flange associated with that recess. A set of tear lines is included between the flanges of adjacent unit packages so that a user of the package may tear along the tear lines to separate a unit package.

The recesses of the package and the dosage forms disposed in the recesses may have essentially any shape. For example, the dosage forms may be disk-shaped tablets, oblong capsules or square-shaped pills. Shapes for recesses include circular, oblong, polygonal or star shapes in the plane of the blister sheet.

Furthermore, the walls and bottom of the recesses may define a shape in the form of a surface of revolution, about a vertical axis normal to the flange surrounding each of the recesses. For example, the recesses may have a curved, cup-like shape. Where the dosage forms are disc-shaped, they may each have an edge which contacts the walls of the recess in which each dosage form is disposed. The edge and walls define an annular region of contact coaxial with the vertical axis of the recess. The edge of such a disc-shaped dosage form may comprise a bevel which contacts the walls of the recess. The annular region of contact prevents shifting of the dosage form within the blister and the damage to the dosage form associated with such shifting.

To further ensure that fragile dosage forms are not damaged upon opening of the package, the packaged dosage form may further comprise indicia on the blister package directing the user not to push the bottom of the recesses to eject a dosage form from the package. Because some of the prior art packages are of the push-through type, users of packages may attempt to push a frangible dosage form through the lidding material sheet by collapsing the blister sheet recess in which the dosage form is disposed. Indicia provided on the package provides additional protection of the dosage form against damage. The indicia may be visible from a downwardly-facing bottom surface of the blister sheet and may be printed on the bottom surface of the blister sheet.

The blister sheet may be opaque to visible light. The opaque blister sheet can bear the above-mentioned indicia. The opaque blister film tends to deter the user from pushing the bottom of the blister. The lidding material and blister sheet may be substantially moisture-impervious, where the dosage form is a pharmaceutical which should be protected from moisture and light.

A blister package in accordance with preferred aspects of the invention includes a unitary blister sheet defining a plurality of unit package regions. Each package region of the blister sheet has a recess, in which a dosage form may be disposed, with an open top and a flange surrounding the recess. A unitary sheet of lidding material is peelably sealed to the flanges of the package regions for covering dosage forms which may be disposed in the recesses. Thus, the blister package includes a plurality of unit packages, each unit package incorporating one unit package region of the blister sheet and the portion of the lidding sheet which overlies that unit package region. The sheet of lidding material has lines of weakness between adjacent unit package regions so that each unit package is separable from the blister package. The lines of weakness have perforations and spaces between perforations. The lines of weakness cross each other to define intersections at corners of the unit packages. The lines of weakness intersect at the spaces, as opposed to the perforations, of the lines of weakness. These spaces form a dimple at the intersections when the package is torn along the tear lines to separate the unit packages.

Unsealed areas aligned with the intersections of the lines of weakness may be provided at a corner of each unit package. The unsealed areas provide a portion of lidding material on the corner of a separated package unit which can be grabbed by a user. The user may then peel back the lidding on the unit package to obtain access to a dosage form which may be disposed in the recess of the unit package. The blister sheet may be recessed below the flanges of the unit package in the corner unsealed areas to provide a separation of the blister sheet and lidding material for easier opening by the user. Prior to obtaining access to the unsealed area, the user must separate the lid and blister at the dimple at the intersection between the unit packages. This dimple hides the unsealed area from a child who has torn the package along the perforations.

Elongated unsealed areas may be provided along the borders between adjacent unit packages. The elongated unsealed areas are disposed in alignment with the lines of weakness and extend to the corner unsealed areas. This aspect improves the operability of the package, which is formed by heat-sealing the blister sheet and lidding material together.

BRIEF DESCRIPTION OF THE DRAWINGS

These and other features, aspects, and advantages of the present invention will become better understood with regard to the following description, appended claims and accompanying drawings where:

BRIEF DESCRIPTION OF THE PREFERRED EMBODIMENT

Figure 1:
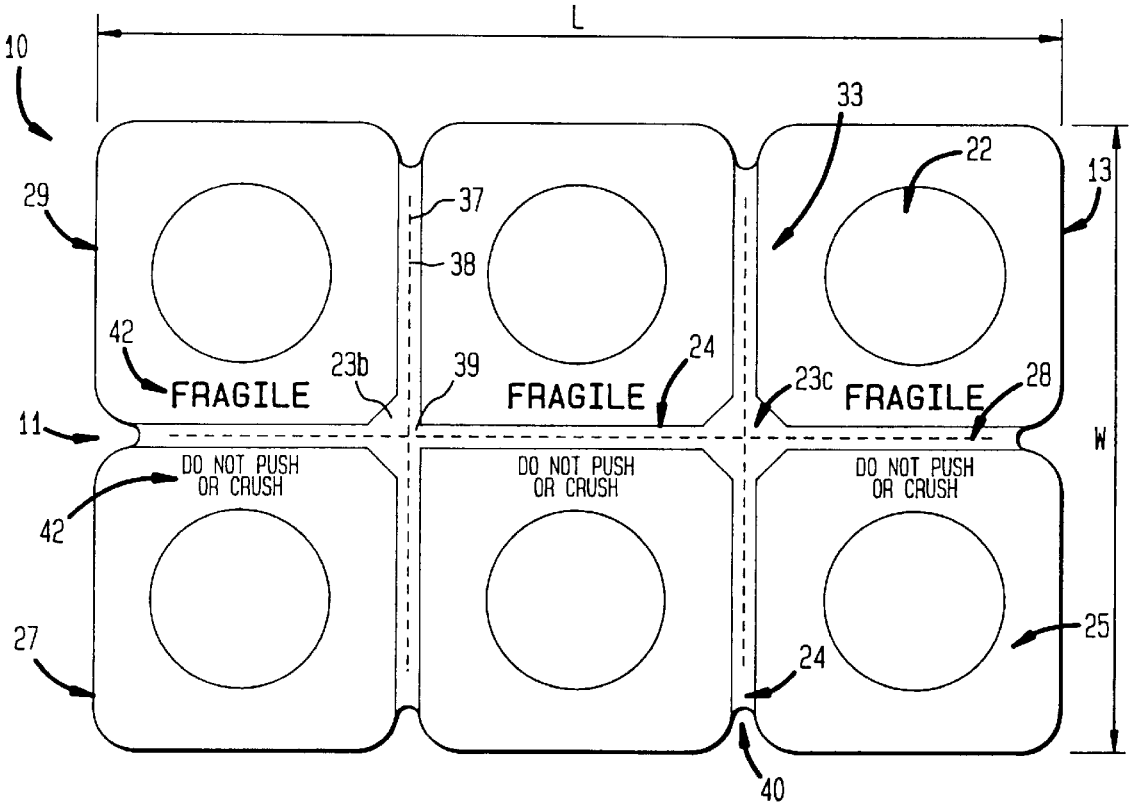
FIG. 1 is a bottom plan view of a packaged dosage form in accordance with one embodiment of the invention.
Figure 2:
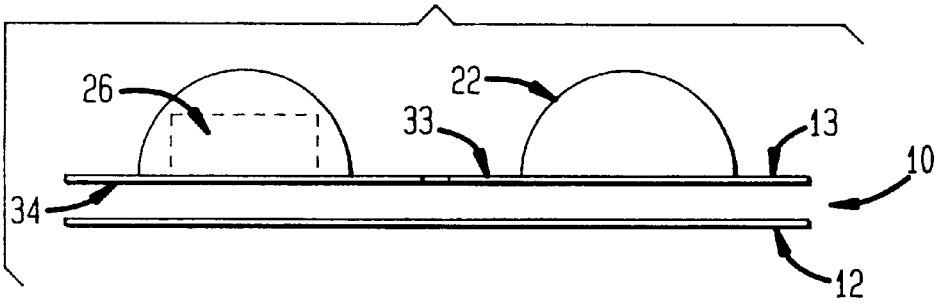
FIG. 2 is an exploded, front elevation of the packaged dosage form of FIG. 1.

A packaged dosage form in accordance with one embodiment of the present invention is illustrated by FIGS. 1 through 5. As shown in FIG. 2, the packaged dosage form comprises a blister package 10 formed by a blister sheet 13 defining recesses 22 in which frangible dosage forms 26 are disposed. Each recess 22 has the open top 30 seen in FIG. 4, a closed bottom 31 remote from the top, and walls 32 extending between the open top 30 and the bottom 31. The blister sheet 13 defines a flange 33 surrounding the open top of each recess and a generally planar top surface 34 facing in an upward direction z. A sheet of lidding material 12 overlies the recesses and is peelably attached to the flange 33 of the blister sheet 13 to cover the dosage forms 26 therein.

The package 10 shown in FIG. 1 has the form of a card of 6 tablets 26 contained in 6 recesses 22. The blister sheet 13 has a plurality of recesses 22 containing tablets 26 arranged, for example, in rows and columns. Thus, the blister package includes a plurality of unit packages 27, each unit package incorporating one recess 22, a portion of the lidding sheet 12 overlying that recess, and the flange 33 associated with that recess. The unit packages 27 are substantially rectangular in shape in the package 10 of FIG. 1 and are mutually perpendicular to one another. The boundaries of each unit package 27 are defined by lines of weakness 28 in the blister package 10, which are shown in FIG. 1 as straight, dashed lines. The lines of weakness 28 are therefore located between the flanges of adjacent unit packages so that a user of the package may tear along the lines of weakness or tear lines 28 to separate a unit package 27 from the blister package 10.

In the embodiment of FIG. 1, the blister package card is 104 millimeters is length and 68 millimeters is width, which accommodates six ½ inch diameter tablets. The package units located at a corner of the card are 34 millimeter squares with the center of the recess 22 located 16 millimeters from the edge of the card. The other package units are 36 millimeters in length and 34 millimeters in width.

The lines of weakness 28 in the blister package 10 are comprised of perforations 37 and spaces 38. The perforations are essentially slits or weakened points in the blister sheet 13, penetrating through the sheet of lidding material 12. The lines of weakness cross each other to define intersections 39 at corners of the unit packages. The lines of weakness intersect at the spaces 38, as opposed to the perforations 37, of the lines of weakness 28. These spaces form a dimple at the intersections 39, which is an important aspect of the invention, as will be described in more detail below.

The blister sheet 13 and sheet of lidding material 12 of the blister package 10 define a perimeter 29 bounding the blister package. The lines of weakness 28 extend almost to the perimeter 29 of the card, but stop short of the perimeter by at least 1 mm. This feature aids in the child resistancy of the package by making the initial tear more difficult to make by a child, although relatively easy for an adult. The perimeter 29 includes indentations or notches 40 which extend inwardly toward the outer ends of the tear lines to serve as intuitive indicators of a separation area for the user of the package.

For effervescent tablets which are very soft, moisture sensitive tablets by conventional standards, the package must have a very low moisture vapor transmission rate (MVTR) to provide for chemical stability. Thus, a package material incorporating aluminum foil is preferable because it exhibits these qualities in addition to being available in relatively thin sheet suitable for packages of this kind. The package must be rigid and durable so as to provide physical protection of the soft tablet. A plastic material exhibiting these qualities is therefore preferable.

Figure 3:
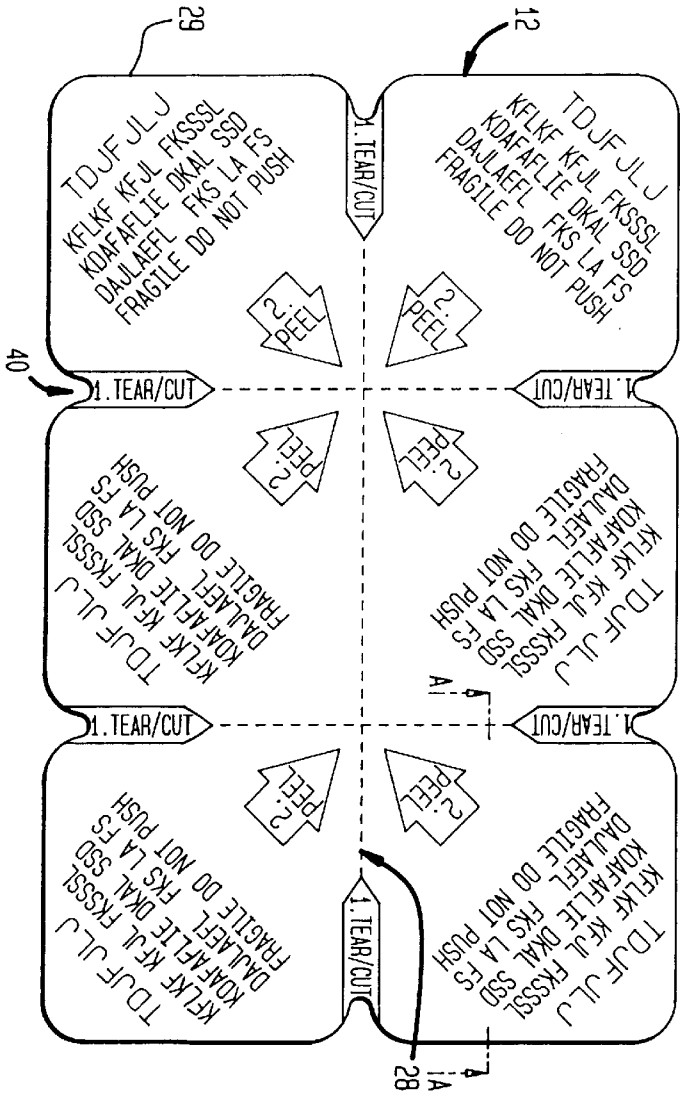
FIG. 3 is a top plan view of the packaged dosage form of FIGS. 1–2.
Figure 5:
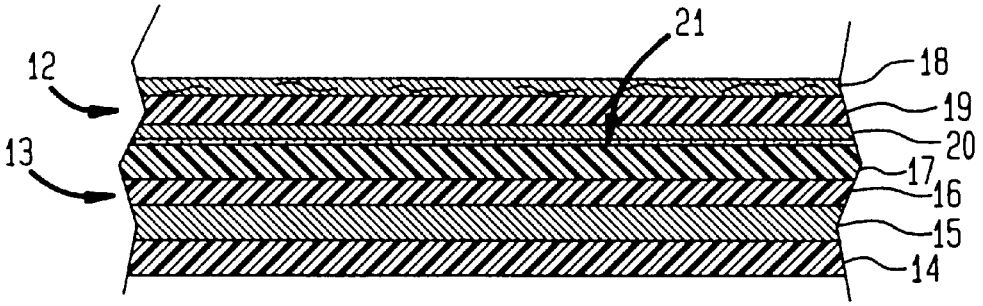
FIG. 5 is a schematic detail of the sectional view of FIG. 4.

FIG. 1 illustrates the bottom 11 of the blister package 10 and FIG. 3 illustrates the top or "lid" 12 of the blister package. Numerous satisfactory sheet materials for the blister sheet 11 and lid 12 are available. These conventional materials include polymeric and metallic materials and laminates including these materials, typically with conventional adhesives for forming peelable connections between the blister and lid. The particular materials described below are merely exemplary of numerous commercially available materials. The bottom 11 of the package is formed from a blister sheet 13 comprising a laminate material formed to provide recesses 22 as further described below. The bottom layer 14 of the blister sheet seen in FIG. 5 is comprised of a 60 micron thick layer of polyvinyl chloride (PVC). A 25 micron thick layer 15 comprised of polyamid film overlies the PVC layer and is secured to the PVC layer by an adhesive. A 60 micron layer of aluminum foil 16 overlies the polyamid file and is secured to the polyamid film with an adhesive. Another 60 micron layer of PVC 17 is adhered to the aluminum foil 16 using an adhesive.

The aluminum layer of the blister sheet also has a 98.5% purity and a temper of H01 (soft). The blister sheet material may be made opaque by including a layer of primer and opaque ink coating that side of the aluminum foil which confronts the polyamid film, the primer comprising an epoxy/phenol lacquer. The ink masks the aluminum appearance of the foil, which would be visible through the transparent polyamid and PVC layers. The primer prepares the surface of the aluminum foil to receive the coating of opaque ink, which is preferably a white ink as specified below so that words may be imprinted in a dark-colored ink on the white ink so as to be visible from the bottom of the blister package. The words "Fragile Do Not Push or Crush" may be imprinted on the ink, as shown in FIG. 1 and sealed with the laminations to prevent scratching or scuffing of the inks. The particular blister material including all of the aforementioned layers is available from Lawson Mardon Packaging Company of Shelbyville, Kentucky under their specification No. K 5784-0005. The specifications for the foregoing layers and adhesive are as follows:

| Layer No. | Material | Lawson Mardon Specification No. | Thickness, microns | Weight, g/m$^2$ |
|---|---|---|---|---|
| 14 | PVC | 6532 | 60 | 82.8 +/− 8.28 |
| | Adhesive | LE 406 | nominal | 4.0 +/− 1.2 |
| 15 | Polyamid Film | 6704 | 25 | 28.75 +/− 2.88 |
| | Adhesive | LE 406 | nominal | 5.0 +/− 1.4 |
| | Opaque White Ink | PV 25 | nominal | 5.0 +/− 1.4 |
| | Primer | Lacquer LA 752 | nominal | 2.0 +/− 0.6 |
| 16 | Aluminum Foil | Dulls PVN 651 | 60 | 162.0 +/− 12.96 |
| | Adhesive | LE 406 | nominal | 4.0 +/− 1.3 |
| 17 | PVC | 6532 hard | 60 | 82.8 +/− 8.28 |

The top of the blister package 10 is a sheet of lidding material 12, also comprised of a multi-layered laminate material. FIG. 5 shows the top layer 18, which is comprised of a layer of 30 pound, machine glazed kraft paper overlying a 12 micron layer of polyester film 19. Adhesive secures the polyester film 19 to the paper layer 18. The polyester film 19 overlies a 25 micron thick layer of aluminum foil 20 and is secured to the aluminum foil by an adhesive. The aluminum layer of the lidding material has a first side to which a heat seal coating is applied and a second side, opposite its first side, which is adhered to the polyester. The second side of the aluminum foil has a bright, reflective finish. This particular type of lidding material is supplied by the Lawson Mardon Packaging Company under specification No. 15144 and is also known as an "EZ PEEL" material. The specifications for the foregoing layers and adhesive are as follows:

| Layer No. | Material | Lawson Mardon Specification No. | Thickness, microns | Weight, g/m$^2$ |
|---|---|---|---|---|
| 18 | 30 pound paper | 2916 | | 48.9 +/− 5.00 |
| | Adhesive | 5060 | negligible | 4.0 +/− 0.6 |
| 19 | Polyester Film | 2301 | 12 | 16.9 +/− 1.69 |
| | Adhesive | 5060 | negligible | 2.5 +/− 0.6 |
| 20 | Aluminum Foil | 3300 | 25 | 68.6 +/− 6.86 |
| Heat Seal | Vinyl/ Acrylic Lacquer | 4563 | | 7.0 +/− 1.3 |

As further discussed below, the opening properties of the package are affected by the strength of the bond between the blister and lid. Under typical sealing conditions, the EZ Peel material provides a peel strength in a range of about 1 to 1.7 pounds per inch. A material with a more aggressive adhesive, commonly referred to as a "CR PEEL" material and available under Lawson Mardon Packaging Co. specification No. 15127, can be used to provide a peel strength in a range of about 2 to 3.3 pounds per inch. Such a higher strength enhances child resistance of the package, but makes opening the package somewhat more difficult. The specifications for the CR Peel material are as follows:

| Layer No. | Material | Lawson Mardon Specification No. | Thickness, microns | Weight, g/m$^2$ |
|---|---|---|---|---|
| 18 | 30 pound paper | | | 48.9 +/− 4.89 |
| | Adhesive | | negligible | 3.0 +/− 0.6 |
| 19 | Polyester Film | | 48 | 16.9 +/− 1.69 |
| | Adhesive | | negligible | 2.5 +/− 0.6 |
| 20 | Aluminum Foil | | 100 | 68.6 +/− 6.86 |
| Heat Seal | Vinyl/ Acrylic Lacquer | 4516 or 4503 | | 7.0 +/− 1.3 |

The sealing process uses heat and pressure to activate the heat seal provided on the lidding material 12. The blister sheet 13 is placed on a sealing face of a bottom plate of a sealing machine, having the dosage forms already placed in the recesses 22 of the blister sheet 13. The bottom plate has blister cavities corresponding to the recesses in the blister sheet so that the recesses 22 containing the tablets 26 are recessed below a raised face of the bottom plate, the raised face being the surface which applies heat and pressure to the blister sheet 13 and sheet of lidding material 12. Thus, the raised face produces sealed areas 25 around the periphery of the recesses 22. Prior to sealing, the sheet of lidding material 12 is placed on the blister sheet 13, overlying the dosage forms in the recesses. A top plate of the sealing machine is movable relative to the bottom plate and either the top plate, the bottom plate, or, most preferably, both plates are heated. When the top and bottom plates are brought into engagement with one another, the heat seal on the lidding material is activated by heat and pressure of the plates. Because the bottom plate has blister cavities, the recesses 22 and the dosage forms therein are not crushed during the sealing process. After a prescribed period of time, the plates are released and a formed sheet of blisters having dosage forms contained therein is removed from the sealing machine. Control of process parameters for blister sealing is well known in the art. For example, greater heat, pressure and sealing times tends to increase the peel strength.

The bottom plate is designed with cavities for forming unsealed areas 23 and 24 in the blister package. As seen in FIG. 1, the blister package has corner unsealed areas 23 and elongated unsealed areas 24. The elongated unsealed areas 24 extend to the perimeter 29 of the blister package, in alignment with the lines of weakness 28 and join with corner unsealed areas 23, which are located at the corners of each unit package. The elongated unsealed areas 24 join the notches 40 on the perimeter 29 of the package 10 and are aligned with the lines of weakness 28. These unsealed areas 23 and 24 are formed by cavities in the bottom plate during the sealing process. Due to the cavities in the bottom plate, the force applied to the plates during sealing is focused on the sealed areas 25 of the blister sheet and sheet of lidding material, applying a greater pressure on the heat seal of the lidding material as compared to a plate having no recessed areas or cavities. As seen in FIG. 1, the corner unsealed areas 23 are disposed at the intersections 39 of the lines of weakness 28 so that the lines of weakness 28 are entirely located within the unsealed areas 23 and 24. In addition, the intersection 39 is also located in alignment with the corner unsealed areas 23.

The corner unsealed areas 23 provide a portion of lidding material on the corner of a separated unit package 27 which can be grabbed by a user so that the user may then peel back the lidding on the unit package to obtain access to a tablet 26. The flanges 33 of the blister sheet 13 may be recessed in the corner unsealed areas 23 to provide a separation of the blister sheet and lidding material for easier opening by the user. The corner unsealed areas 23 in the embodiment of FIG. 1 are in the form of an 8 millimeter square 23*c* at an intersection of four unit packages and a triangle 23*b* having two 8 millimeter long sides at an intersection of two unit packages.

This embodiment of the invention also provides graphics to guide the consumer as to the proper opening procedure, which will further avoid damage to the frangible tablets 26. Consumers tend to attempt to operate the package 10 as a push-through type package thereby crushing the tablet against the sheet of lidding material. To prevent this, the graphics or indicia have been developed. An example is shown in FIG. 3. On the lidding material 12, which is at the top of the package shown in FIG. 3, there are two arrows indicating the two steps required to properly open the package. The first arrow is long and narrow and is located on top of each exterior perforation. This arrow has the words "1. Tear/Cut." The second arrow is located over a portion of the unsealed area pointing towards the inside corner of the blister. The text "2. Peel" may be imprinted as a negative within the area to further indicate that there are two steps involved. Additionally, there are dashes printed on top of the perforations that connect the heads of the first arrows to indicate the lines of weakness 28 on the package. The word "Fragile—Do Not Push" may be imprinted diagonally across on the sheet of lidding material. The additional "do not push" indicia 42 discussed above are provided on the blister sheet so that the additional indicia 42 are visible from the bottom of the package. Thus, the user or 20 consumer is alerted to the possibility of damaging the tablets 26, regardless of which side of the package 10 the user is observing. These graphics play a significant role in educating the user on the procedure for opening the blister package 10.

The dosage form 26 is an effervescent tablet which dissolves when administered orally to a patient. The tablet, to be dissolved easily within the mouth of a patient, is comprised of an effervescent composition together with the active ingredients of the tablet. Tablets of this type are described in U.S. Pat. Nos. 5,178,878 and 5,223,264, which have been incorporated by reference herein. The tablet is a very soft, moisture sensitive tablet which is easily cracked or crumbled into a power during transport. The hardness of these tablets in this example is typically below 20 Newtons and can be below about 10 Newtons. Furthermore, a package containing such tablets can be easily damaged or destroyed during opening of a package. Although the orally administered, easily dissolvable tablets provide many advantages to patients, these tablets present significant problems in packaging. The tablet shown in FIG. 4 is a disk-shaped tablet having a radius of r and a circular circumferential edge 36 formed by the edge surface and end surface of the tablet.

Figure 4:
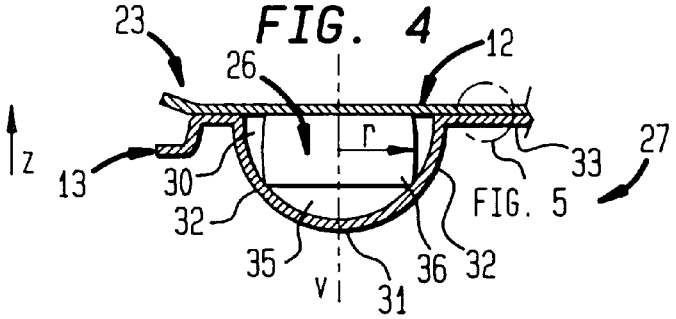
FIG. 4 is partial sectional view taken along line A—A in FIG. 3, showing a packaged dosage form of FIGS. 1–3.

The recess 22 of each unit package, designed to substantially reduce damage to the tablets 26 during transport and opening of the package, is shown in FIG. 4 and is essentially a dome in the shape of a part of a sphere having a radius slightly larger than the radius of the circular tablet. The recess 22 is formed with a sufficient depth to accommodate the dosage form 26. In the example of FIG. 1, the recess has a 20 millimeter diameter open top for the tablet having a ½ inch diameter. The walls 32 and bottom 31 of the recesses 22 define a shape in the form of a surface of revolution, about a vertical axis v, which is normal to the flange 33 surrounding each of the recesses 22. Thus, in this example, the recesses have a curved, dome-like or cup-like shape.

To prevent shifting of the tablet within the recess 22, a circumferential edge of the frangible dosage form 26 disposed in each recess 22 engages the walls 32 of each recess so that the walls hold the dosage form away from the bottom 31 of the recess and adjacent the lidding material 12. Edge 36 and the walls 32 of the recess 22 define together a region of contact at their interface. The region of contact is an annular region coaxial with the vertical axis v. Due to the dome-like shape of the recess 22, a cushion of empty space 35 is formed between each dosage form 26 and the bottom 31 of the recess 22. The tablets typically are placed into each recess of the blister by a robotic handler which grasps each tablet and places the tablet into the individual recess. One such robotic system is disclosed in commonly assigned U.S. Provisional Application Ser. No. 60/077,363, the disclosure of which is hereby incorporated by reference herein. For effervescent tablets, it is important that packaging occur in a dry environment.

In operation, the user of a packaged tablet will, upon viewing the indicia on the package, separate a unit package 27 from the blister package 10 by tearing along the lines of weakness 28, beginning at a notch 40 on the package. When the tear has proceeded along the line of weakness 28 to the intersection 39, the user will make another tear beginning at another notch 40 adjacent the selected unit package 27. When this second tear reaches the intersection 39, the user must break the dimple at the intersection 39 between the unit packages. At this stage in the procedure, that is, the lid and blister will tend to adhere to one another in the area of the dimple. Thus, the corner unsealed area 23 is hidden from view, which is a child resistant aspect of the invention.

The adult will realize, upon reading the instructions on the top of the blister package 10, that a peelable tab is provided at the unsealed corner. After the dimple at the intersection is broken, the unsealed area is revealed, having a portion of the lidding material unattached to the blister sheet as seen in FIG. 4. The user then grabs the lidding material and pulls back the lidding material to expose the tablet in the recess 22. The user can then pour the tablet out of the blister into his hand. The user can tilt the tablet by engaging one side of the tablet with a finger. The generally hemispherical shape of the recess helps to free the tablet without the need for rough handling.

Figure 6:
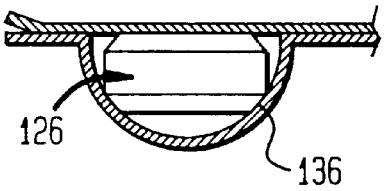
FIG. 6 is a partial sectional view taken along line A—A in FIG. 3, showing a packaged dosage form of a second embodiment of the invention.
Figure 7:
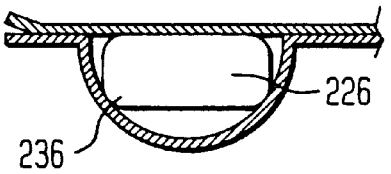
FIG. 7 is a partial sectional view taken along line A—A in FIG. 3, showing a packaged dosage form of a third embodiment of the invention.

There are several alternative embodiments of the invention. Thus, as seen in FIG. 6, the packaged dosage form may be comprised of a tablet 126 having, instead of the tablet with substantially perpendicular surfaces, shown in FIG. 4, a tablet 126 having a beveled edge 136. This arrangement is beneficial because where the tablet 126 has a beveled edge 136, the crumbling within the recess is reduced. Another alternative which would reduce the crumbling of the tablet is shown in FIG. 7, where the tablet 226 has a curved edge 236.

Alternative shapes for recesses include circular, oblong, polygonal or star shapes in the plane of the blister sheet. Conical shapes and paraboloids of revolution may also be used for the shape of the recess. The recesses of the package and the dosage forms disposed in the recesses may have essentially any shape. For example, the dosage forms may be disk-shaped tablets, oblong capsules or square-shaped pills. The package could also be formed for dosage forms of almost any size.

The material utilized for the blister sheets and sheets of lidding material may be altered to suit particular requirements. For instance, to provide a more child resistant blister package, the type of heat seal coating may be varied and the sealing conditions, such as time, temperature and pressure, under which the material is heat sealed may be varied to provide a stronger seal between the blister sheet and sheet of lidding material.

The thickness of the layers may vary slightly without adverse effect on the invention. The blister sheet material may have a layer of polyamid film which is 45 microns thick and the aluminum may be 100 microns thick. This lidding material is also known as "CR PEEL."

With regards to the indicia on the bottom and top of the blister package 10, the particular choice of words discussed are not essential. For instance, instead of "peel" the word could be "Separate" or some other synonym. Instead of "Tear/Cut," "separate" or "detach" can be used. "Warning—tablet easily damaged" or "handle with extreme care" may also be used instead of "Fragile—do not push or crush". The colors of the indicia can be varied creatively to call attention to the words "fragile" or to distinguish the steps required to open the package.

We claim:

1. A blister package including:

(a) a unitary blister sheet defining a plurality of unit package regions, each said unit package region including a recess having an open top and a flange surrounding said recess; and (b) a unitary sheet of lidding material peelably sealed to said flanges, whereby said package includes a plurality of unit packages, each said unit package incorporating one unit package region of said blister sheet and a portion of said sheet overlying that unit package region, (c) said sheet of lidding material having lines of weakness extending along borders between adjacent unit package regions, each said line of weakness including perforations and spaces between perforations, said lines of weakness crossing one to define intersections, said lines of weakness having spaces at said intersections;

(d) said blister sheet and said sheet of lidding material defining elongated unsealed areas along said boarders, said elongated unsealed areas being aligned with said lines of weakness;

(e) said blister sheet and said sheet of lidding defining corner unsealed areas at said intersections of said lines of weakness; and (f) said blister sheet and said sheet of lidding material defining a perimeter including notches, said elongated unsealed areas extending to said notches.

2. A package as claimed in claim 1 wherein said blister sheet and said sheet of lidding material define corner unsealed areas aligned with said intersections of said lines of weakness and said flange of said blister sheet includes a recessed portion disposed beneath said corner unsealed areas.

3. A packaged dosage form including a package as claimed in claim 1 and a plurality of pharmaceutical dosage forms disposed in said recesses.

4. A blister package including:

(a) a unitary blister sheet defining a plurality of unit package regions, each said unit package region including a recess having an open top and a flange surrounding said recess; and (b) a unitary sheet of lidding material peelably sealed to said flanges, whereby said package includes a plurality of unit packages, each said unit package incorporating one unit package region of said blister sheet and a portion of said sheet overlying that unit package region, (c) said sheet of lidding material having lines of weakness extending along borders between adjacent unit package regions, each said line of weakness including perforations and spaces between perforations, said lines of weakness crossing one to define intersections, said lines of weakness having spaces at said intersections;

(d) said blister sheet and said sheet of lidding material defining elongated unsealed areas along said boarders, said elongated unsealed areas being aligned with said lines of weakness;

(e) said blister sheet and said sheet of lidding material defining corner unsealed areas at said intersections of said lines of weakness;

(f) said blister sheet and said sheet of lidding material defining a perimeter including notches, said elongated unsealed areas extending to said notches and to said corner unsealed areas.

5. A packaged dosage form, including:

(a) a unitary blister sheet defining a plurality of recesses and a plurality of flanges, each said recess having an open top and an associated flange surrounding said recess; and (b) a unitary sheet of lidding material peelably sealed to said flanges, so that each said recess, said associated flange of said recess, and a portion of said sheet of lidding material define a unit package, each said unit package having at least one adjacent unit package and borders between each said unit package and said at least one adjacent unit package;

(c) said sheet of lidding material having lines of weakness extending along said borders, each of said lines of weakness including perforations and spaces of lidding material between said perforations, said lines of weakness crossing one another to define intersections, each of said lines of weakness having one of said spaces of lidding material at said intersections;

(d) said blister sheet and said sheet of lidding material defining elongated unsealed areas along said borders, said elongated unsealed areas being aligned with said lines of weakness, and said blister sheet and said sheet of lidding material defining a perimeter including notches, said elongated unsealed areas extending to said notches; and (e) a frangible dosage form having an associated recess, said dosage form disposed in said associated recess and engaging said walls of said associated recess so that said walls hold said dosage form away from said closed bottom and adjacent said lidding material so that there is an empty space between each said dosage form and said closed bottom of said associated recess.

6. A packaged dosage form as claimed in claim 5 wherein said blister sheet and said sheet of lidding material define corner unsealed areas aligned with said intersections of said lines of weakness at a corner of each said unit package.

7. A packaged dosage form as claimed in claim 6 wherein said blister sheet is recessed below said flanges in said corner unsealed areas.

8. A packaged dosage form, including:

(a) a unitary blister sheet defining a plurality of recesses and a plurality of flanges, each said recess having an open top and an associated flange surrounding said recess; and (b) a unitary sheet of lidding material peelably sealed to said flanges, so that each said recess, said associated flange of said recess, and a portion of said sheet of lidding material define a unit package, each said unit package having at least one adjacent unit package and borders between each said unit package and said at least one adjacent unit package;

(c) said sheet of lidding material having lines of weakness extending along said borders, each of said lines of weakness including perforations and spaces of lidding material between said perforations, said lines of weakness crossing one another to define intersections, each of said lines of weakness having one of said spaces of lidding material at said intersections;

(d) said blister sheet and said sheet of lidding material defining elongated unsealed areas along said borders, said elongated unsealed areas being aligned with said lines of weakness, and said blister sheet and said sheet of lidding material defining a perimeter including notches, said elongated unsealed areas extending to said notches; and (e) a frangible dosage form having an associated recess, said dosage form disposed in said associated recess and engaging said walls of said associated recess so that said walls hold said dosage form away from said closed bottom and adjacent said lidding material so that there is an empty space between each said dosage form and said closed bottom of said associated recess;

(f) said blister sheet and said sheet of lidding material defining corner unsealed areas aligned with said intersections of said lines of weakness at a corner of each said unit package;

(g) said elongated unsealed areas extending to said corner unsealed areas.

* * * * *

UNITED STATES PATENT AND TRADEMARK OFFICE

CERTIFICATE OF CORRECTION

PATENT NO. : 6,155,423

DATED : December 5, 2000

INVENTOR(S) : Katzner et al.

It is certified that error appears in the above-identified patent and that said Letters Patent is hereby corrected as shown below:

Column 5, line 20, "is length" should read --in length--
Column 5, line 20, "is width" should read --in width--
Column 5, line 53, "sheet" should read --sheets--
Column 8, line 4, "tends" should read --tend--
Column 8, line 59, delete "20"
Column 9, line 42, "occur" should read --occurs--
Column 10, line 59, "boarders" should read --borders--
Column 11, line 27, "boarders" should read --borders--

Signed and Sealed this

Twenty-second Day of May, 2001

Nicholas P. Godici

*Attest:*

NICHOLAS P. GODICI

*Attesting Officer*

*Acting Director of the United States Patent and Trademark Office*